US011802015B2

(12) United States Patent
Okubo

(10) Patent No.: US 11,802,015 B2
(45) Date of Patent: Oct. 31, 2023

(54) IMAGE FORMING APPARATUS

(71) Applicant: Konica Minolta, Inc., Tokyo (JP)

(72) Inventor: Takahiro Okubo, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 140 days.

(21) Appl. No.: 17/370,465

(22) Filed: Jul. 8, 2021

(65) Prior Publication Data

US 2022/0011708 A1 Jan. 13, 2022

(30) Foreign Application Priority Data

Jul. 10, 2020 (JP) ..... 2020-119446

(51) Int. Cl.

| | |
|---|---|
| ***B65H 5/36*** | (2006.01) |
| ***B65H 5/26*** | (2006.01) |
| ***G03G 15/00*** | (2006.01) |
| ***B65H 85/00*** | (2006.01) |

(52) U.S. Cl.

CPC ..... *B65H 5/36* (2013.01); *B65H 5/26* (2013.01); *B65H 85/00* (2013.01); *G03G 15/6529* (2013.01); *B65H 2407/21* (2013.01)

(58) Field of Classification Search

CPC ..... B65H 5/06; B65H 5/066; B65H 5/068; B65H 5/26; B65H 5/36; B65H 5/38; B65H 85/00; B65H 2404/74; B65H 2404/7414; B65H 2404/7431; B65H 2407/21; B65H 2601/522

See application file for complete search history.

(56) References Cited

U.S. PATENT DOCUMENTS

2004/0251613 A1* 12/2004 Quesnel ..... B65H 9/002 271/243
2007/0057444 A1* 3/2007 Sagawa ..... G03G 15/6558 271/225
2007/0273090 A1* 11/2007 Kawaguchi ..... B65H 9/002 271/226
2010/0310262 A1* 12/2010 Nanayama ..... B65H 7/06 399/397
2015/0274477 A1* 10/2015 Kodama ..... B65H 29/14 271/3.19

FOREIGN PATENT DOCUMENTS

JP 2013148740 A 8/2013

* cited by examiner

*Primary Examiner* — Prasad V Gokhale
(74) *Attorney, Agent, or Firm* — CANTOR COLBURN LLP

(57) ABSTRACT

An image forming apparatus includes: as a conveyance to convey an object formed with an image, an upstream-side conveyance path; an intermediate conveyance path connected to a downstream end part of the upstream-side conveyance path via a first bent part; and a downstream-side conveyance path connected to the intermediate conveyance path via a second bent part, wherein the second bent part is bent to a side opposite to the first bent part, on an inner side of a bend of the first bent part, a friction reducing part capable of abutting with the object conveyed in the first bent part is provided, and the intermediate conveyance path includes: a pair of guide parts forming the intermediate conveyance path; and a friction reducing part that is provided on both a pair of the guide parts and is capable of abutting with the object conveyed between a pair of the guide parts.

13 Claims, 4 Drawing Sheets

IMAGE FORMING APPARATUS

CROSS-REFERENCE TO RELATED APPLICATIONS

The present invention claims priority under 35 U.S.C. § 119 to Japanese Patent Application No. 2020-119446, filed on Jul. 10, 2020, is the entire content of which is incorporated herein by reference.

BACKGROUND

Technological Field

The present invention relates to an image forming apparatus, more specifically, a conveyance path structure in which an object formed with an image is conveyed in the image forming apparatus.

Description of the Related Art

JP 2013-148740 A describes an image forming apparatus including a friction resistance reducing part that reduces frictional resistance with paper, inside a bent part of a bent conveyance path.

In order to achieve both downsizing of an image forming apparatus and compatibility with high-rigidity paper, it is desired to reduce frictional resistance in a bent conveyance path and convey the paper at a high speed.

SUMMARY

The present invention has been devised in view of the above circumstance, and an object is to provide an image forming apparatus capable of achieving both downsizing of the apparatus and high-speed conveyance of an object.

To achieve the abovementioned object, according to an aspect of the present invention, an image forming apparatus reflecting one aspect of the present invention comprises: as a conveyance to convey an object formed with an image, an upstream-side conveyance path; an intermediate conveyance path connected to a downstream end part of the upstream-side conveyance path via a first bent part; and a downstream-side conveyance path connected to the intermediate conveyance path via a second bent part, wherein the second bent part is bent to a side opposite to the first bent part, on an inner side of a bend of the first bent part, a friction reducing part capable of abutting with the object conveyed in the first bent part is provided, and the intermediate conveyance path includes: a pair of guide parts facing each other and forming the intermediate conveyance path; and a friction reducing part that is provided on both a pair of the guide parts and is capable of abutting with the object conveyed between a pair of the guide parts.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
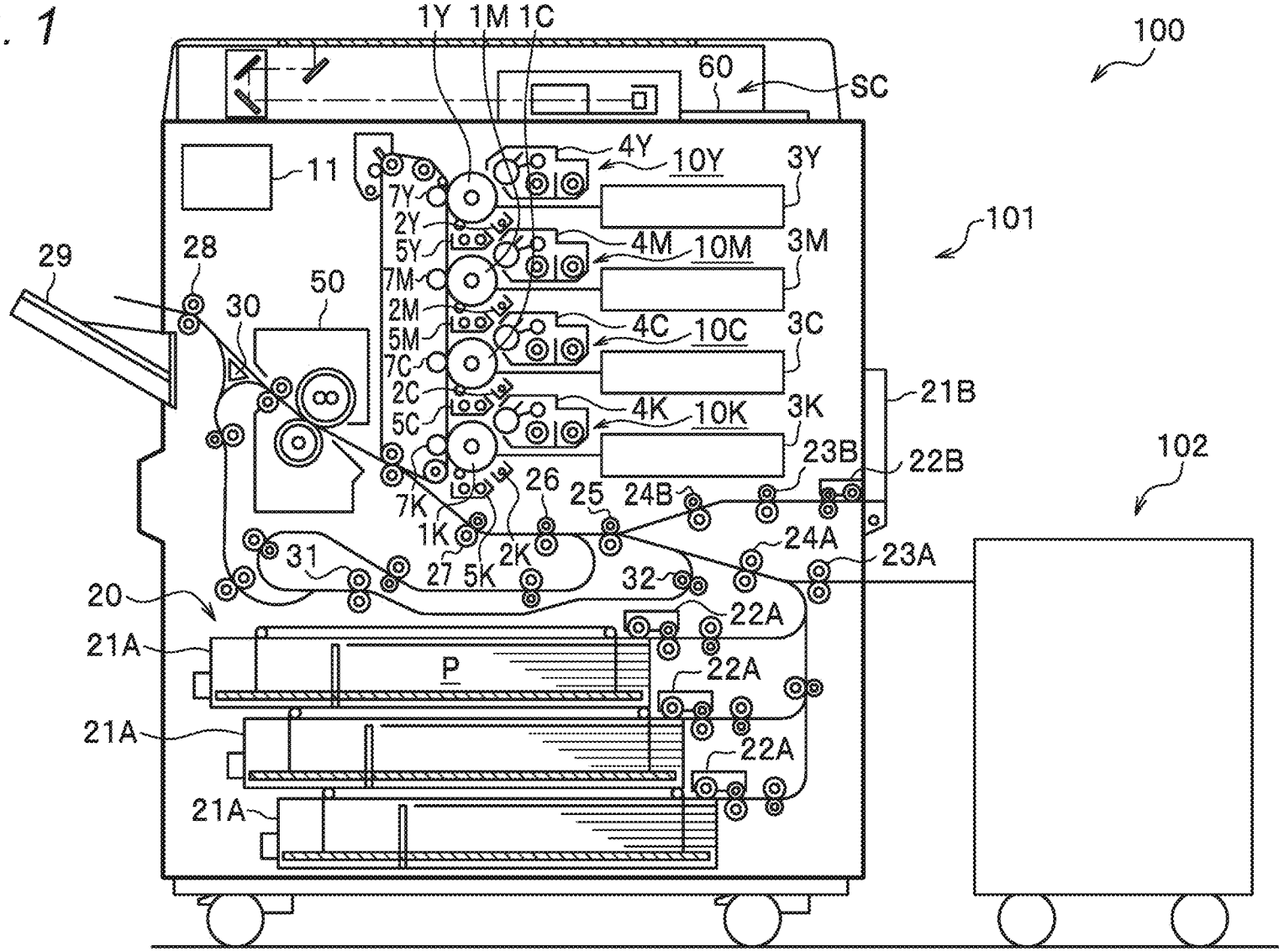
FIG. 1 is a view schematically showing an image forming system according to a first embodiment of the present invention.

Hereinafter, one or more embodiments of the present invention will be described with reference to the drawings. However, the scope of the invention is not limited to the disclosed embodiments. The same components are denoted by the same reference numerals, and redundant description will be omitted.

First Embodiment

As shown in FIG. 1, an image forming system 100 according to a first embodiment of the present invention includes: an image forming apparatus 101; and a paper feeding device 102 capable of supplying paper P to the image forming apparatus 101. The image forming apparatus 101 is an apparatus, such as a copying machine, that forms an image on the paper P as an object, by an electrophotographic method. The image forming apparatus 101 is a so-called tandem color image forming apparatus that forms a full-color image, by arranging a plurality of photoreceptors in a vertical direction to face one intermediate transfer belt.

The image forming apparatus 101 mainly includes a document reading device SC, four sets of image forming parts 10Y, 10M, 10C, and 10K, a fixing device 50, and a control part 11, which are housed in one housing.

The document reading device SC scans and exposes an image of a document by an optical system of a scanning exposure device, and reads the reflected light by a line image sensor, to obtain an image signal. This image signal is inputted to the control part 11 as image data after being subjected to processing such as A/D conversion, shading correction, and compression. The image data inputted to the control part 11 is not limited to the image data read by the document reading device SC, but may be, for example, received from a personal computer connected to the image forming apparatus 101 or from another image forming apparatus.

The four sets of image forming parts 10Y, 10M, 10C, and 10K include the image forming part 10Y that forms a yellow (Y) image, the image forming part 10M that forms a magenta (M) image, the image forming part 10C that forms a cyan (C) image, and the image forming part 10K that forms a black (K) image.

The image forming part 10Y includes a photoreceptor drum 1Y, a charging part 2Y arranged around the photoreceptor drum 1Y, an optical writing part 3Y, a developing device 4Y, and a drum cleaner 5Y. Similarly, the image forming parts 10M, 10C, and 10K include photoreceptor drums 1M, 1C, and 1K, charging parts 2M, 2C, and 2K arranged around the photoreceptor drums 1M, 1C, and 1K, optical writing parts 3M, 3C, and 3K, developing devices 4M, 4C, and 4K, and drum cleaners 5M, 5C, and 5K.

Surfaces of the photoreceptor drums 1Y to 1K are uniformly charged by the charging parts 2Y to 2K, and a latent image is formed on the photoreceptor drums 1Y to 1K by scanning exposure by the optical writing parts 3Y to 3K.

Further, the developing devices 4Y to 4K visualize the latent image on the photoreceptor drums 1Y to 1K by developing with toner. This causes formation of a toner image of a predetermined color corresponding to any of yellow, magenta, cyan, and black, on the photoreceptor drums 1Y to 1K. The toner images formed on the photoreceptor drums 1Y to 1K are sequentially transferred to a predetermined position on a rotating intermediate transfer belt 6, by primary transfer rollers 7Y, 7M, 7C, and 7K.

The toner image made by each color and transferred on the intermediate transfer belt 6 is transferred by a transfer roller 9, to the paper P conveyed at a predetermined timing by a paper conveyance part 20 described later. The transfer roller 9 is arranged so as to be in pressure contact with the intermediate transfer belt 6.

The paper conveyance part 20 conveys the paper Pin accordance with a conveyance path of the paper P defined in the machine. The paper P is housed in a paper feeding tray 21A, and the paper P housed in the paper feeding tray 21A is taken in by a paper feeding part 22A and sent out to the conveyance path. Alternatively, the paper P is housed in a paper feeding tray included in the paper feeding device 102 connected to the image forming apparatus 101, and the paper P held by the paper feeding device 102 is supplied from the paper feeding device 102 to the image forming apparatus 101, to be sent out to the conveyance path.

In this conveyance path, on an upstream side from a transfer position where the toner image is transferred to the paper P (that is, a pressure contact position between the intermediate transfer belt 6 and the secondary transfer roller 9), a plurality of conveyors that convey the paper P are provided. Each conveyor includes a pair of pressure-contacted rollers, and conveys the paper P by rotationally driving at least one of the rollers through a driving unit such as an electric motor. Further, the pair of rollers included in the conveyor are configured such that a pressure contact state between the rollers can be switched to a separated state as needed.

In the present embodiment, from an upstream side to a downstream side in a paper conveyance direction, intermediate conveyance rollers 23A, 24A, and 25, a loop roller 26, and a resist roller 27 are provided as the conveyor. In addition to the conveyor including a pair of rollers, it is possible to widely adopt a configuration in which the paper P is conveyed by having a pair of rotary members, such as a combination of belts or a combination of a belt and a roller, and rotationally driving the rotary members.

The conveyance path of the paper P is formed by a guide member (guide part) that guides conveyance of the paper P This guide member includes a pair of guide plates arranged facing each other at a predetermined distance so as to face both sides of the conveyed paper P However, since this guide member can be replaced by a switching member that switches the paper conveyance direction or by another member, one guide plate may be provided on one side alone of the paper P to form a conveyance path, without necessarily including the pair of guide plates.

Further, in the present embodiment, the predetermined guide plate is provided with a bent portion on an upstream side from the intermediate conveyance roller 25, to form a conveyance path that is bent (hereinafter referred to as "bent conveyance path"). For example, the bent conveyance path is formed between the intermediate conveyance roller 23A on an upstream side and an intermediate conveyance roller 24A on a downstream side. Then, the guide plate forming the bent conveyance path and located on inner side of the paper P conveyed on the bent conveyance path, that is, located on a concave surface side, an electric movable mechanism is provided. This movable mechanism enables the guide plate to be retracted in a direction away from the paper P, starting from a normal position where the guide plate is normally arranged, and to return from the retracted position to the normal position.

In such a conveyance path, the paper P fed from the paper feeding tray 21A or the paper feeding device 102 is sequentially conveyed by the plurality of intermediate conveyance rollers 23A, 24A, and 25 and the loop roller 26 provided from the upstream side to the downstream side, to advance in the conveyance path. Next, before a tip end of the paper P reaches the resist roller 27, the conveyor on the upstream side from the loop roller 26, specifically, the intermediate conveyance rollers 23A, 24A, and 25 are switched from the pressure contact state to the separated state. Therefore, after the intermediate conveyance rollers 23A, 24A, and 25 transition to the separated state, the paper P is conveyed by the loop roller 26 alone. After that, the paper P conveyed by the loop roller 26 is abutted against the resist roller 27 in a rotation stop state, and then the loop roller 26 continues to rotate for a predetermined time to form a loop on the paper P. The action of this loop formation corrects skew of the paper P (skew correction).

Next, when the resist roller 27 starts rotating at a predetermined timing synchronized with a toner image on the intermediate transfer belt 6, the loop roller 26 is switched from a pressure contact state to a separated state as in the intermediate conveyance rollers 23 to 25. That is, after the loop roller 26 transitions to the separated state, the paper P is conveyed by the resist roller 27 alone. This resist roller 27 conveys the paper P to a transfer position while performing swing processing described later while conveying the paper P.

The resist roller 27 is able to swing along a paper width direction CD (a direction orthogonal to a paper conveyance direction FD). This resist roller 27 is connected with a drive mechanism, and can move along the paper width direction CD by being driven by the drive mechanism. Therefore, by moving along the paper width direction CD in accordance with a passing period in which the paper P passes through the resist roller 27, the resist roller 27 can move the conveyed paper P along the paper width direction CD (the swing processing of the paper P). This allows the resist roller 27 to adjust such that a conveyance position of the paper P matches a position of a transferred toner image in the paper width direction CD.

The individual rollers 23A, 24A, 25 to 27 that have been switched to the separated state are switched to the pressure contact state after the paper P has passed through the resist roller 27, or before the subsequent paper P reaches their own rollers. Note that, the swing processing of the paper P by the resist roller 27 is not always necessary to be executed when the position matches the toner image, when operating conditions for regulating execution of swing processing are satisfied, when a user does not want the swing processing, and the like, and it suffices that the swing processing is executed as required.

The fixing device 50 is a device that fixes a toner image on the paper P on which the toner image is transferred by the transfer roller 9. For example, the fixing device 50 includes a pair of fixing members (for example, a pair of rollers) forming a fixing nip part, and a heater to heat one or both of the fixing members.

In this fixing device 50, when the paper P passes through the fixing nip part in a conveyance process of the paper P, a toner image is fixed on the paper P through an action of pressurization by the pair of fixing members and the heat of the fixing members.

The paper P subjected to fixing processing by the fixing device 50 is discharged by a paper discharging roller 28 to a paper discharging tray (discharging tray) 29 attached to an outer side surface of the housing. Further, for also forming an image on a back surface of the paper P, the paper P having finished with image formation on a paper front surface is conveyed by a switching gate 30 to a reversing roller 31 below. The reversing roller 31 sandwiches a rear end of the conveyed paper P and then reversely feeds to reverse the paper P, and feeds to a re-feeding conveyance path. The paper P fed to the re-feeding conveyance path is conveyed by a plurality of re-feeding conveyors, and the paper P is returned to the transfer position. The paper discharging roller 28, the switching gate 30, the reversing roller 31, and the re-feeding conveyor are also included in the paper conveyance part 20.

The control part 11 has a function of controlling the image forming apparatus in an integrated manner. Further, the control part 11 is a computer equipped with a CPU, memory such as ROM and RAM, a hard disk drive (HDD) as an auxiliary storage device, a communication I/F unit, and the like, and these elements are connected to each other via a bus.

By controlling each part of the image forming apparatus (for example, the image forming parts 10Y to 10K, the paper conveyance part 20, the fixing device 50, and the like), the control part 11 executes each process shown below to form a toner image on the paper P.

(1) Charging the photoreceptor drums 1Y to 1K (2) Forming an electrostatic latent image on the photoreceptor drums 1Y to 1K by the optical writing parts 3Y to 3K (3) Attaching toner to the formed electrostatic latent image (4) Primarily transferring the toner image on the photoreceptor drums 1Y to 1K, onto the intermediate transfer belt 6

(5) Conveying the paper P by the paper conveyance part 20

Figure 2:
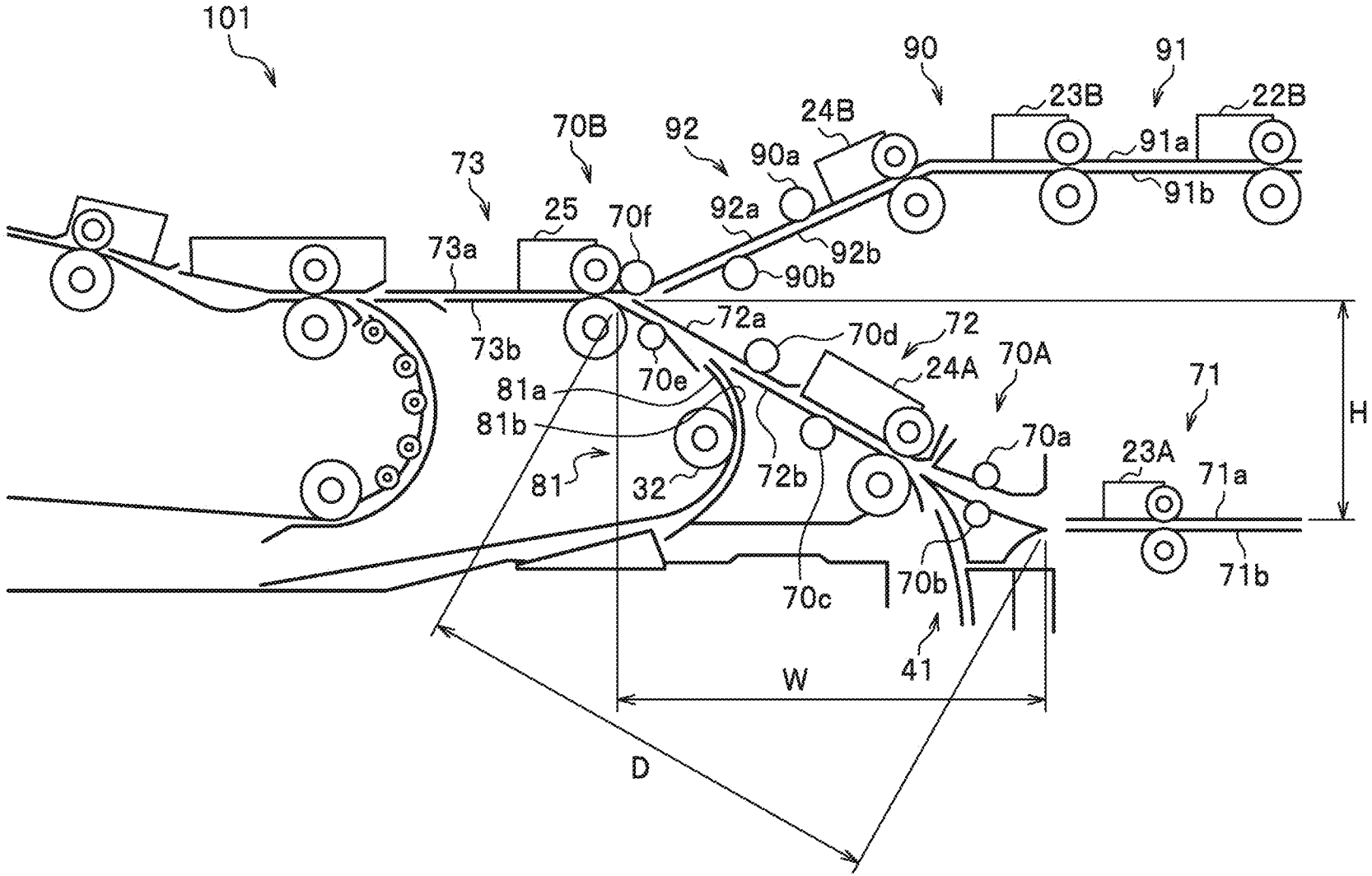
FIG. 2 is a view schematically showing a conveyance path of an image forming apparatus according to the first embodiment of the present invention.

(6) Secondarily transferring the toner image on the intermediate transfer belt 6, onto the paper P (7) Performing fixing processing by the fixing device 50 on the toner image transferred to the paper P As shown in FIG. 2, the image forming apparatus 101 includes, sequentially from an upstream side, an upstream-side conveyance path 71, an intermediate conveyance path 72, and a downstream-side conveyance path 73, as a conveyance path for the paper P. A connection portion of the upstream-side conveyance path 71 and the intermediate conveyance path 72 forms a first bent part 70A, while a connection portion of the intermediate conveyance path 72 and the downstream-side conveyance path 73 forms a second bent part 70B that is bent to an opposite side of the first bent part 70A. The upstream-side conveyance path 71, the intermediate conveyance path 72, and the downstream-side conveyance path 73 form a conveyance path exhibiting an S-shape as a whole. Further, the image forming apparatus 101 includes a duplexing reversing path 81 and a manual feed conveyance path 90 as other conveyance paths that join the conveyance path.

<Upstream-Side Conveyance Path>

The upstream-side conveyance path 71 is a path to convey the paper P conveyed from the paper feeding device 102 into the image forming apparatus 101 in a substantially horizontal direction, and includes a pair of upper and lower guide parts 71*a* and 71*b* facing each other. The guide parts 71*a* and 71*b* are resin or metal plate-shaped members (guide plates) arranged with a guide gap. One of the guide parts 71*a* and 71*b* may include a switching member that switches the paper conveyance direction, or another member. In an intermediate portion of the upstream-side conveyance path 71 in the conveyance direction, there is provided an intermediate conveyance roller 23A that conveys the paper P located in the guide gap between the guide parts 71*a* and 71*b*, to the downstream side.

<Intermediate Conveyance Path>

The intermediate conveyance path 72 is a path to convey the paper P in a diagonally upward direction, and includes a pair of upper and lower guide parts 72*a* and 72*b* facing each other. The guide parts 72*a* and 72*b* are resin or metal plate-shaped members (guide plates) arranged with a guide gap. In an upstream-side end part of the intermediate conveyance path 72 in the conveyance direction, there is provided the intermediate conveyance roller 24A that conveys the paper P located in the guide gap between the guide parts 72*a* and 72*b*, to the downstream side. The guide gap between the guide parts 72*a* and 72*b* in the intermediate conveyance path 72 is set to be larger than a guide gap in the downstream-side conveyance path 73.

A friction coefficient of the guide parts 72*a* and 72*b* in the intermediate conveyance path 72 is set to be smaller than a friction coefficient of guide parts 73*a* and 73*b* in the downstream-side conveyance path 73. Such a difference in the friction coefficient can be set depending on a material, surface treatment, and the like of the guide parts 72*a*, 72*b*, 73*a*, and 73*b*.

A conveyance direction dimension (a distance between the bent parts 70A and 70B) D of the intermediate conveyance path 72 is set to a value that is slightly larger than a conveyance direction dimension of the smallest size paper P that can be conveyed (passed) and that allows the paper P to be conveyed by the intermediate conveyance rollers 24A and 25.

A height direction dimension (a height direction distance between the first bent part 70A and the second bent part 70B) H of the intermediate conveyance path 72 and a width direction dimension (a conveyance direction dimension in plan view, a distance in the conveyance direction between the first bent part 70A and the second bent part 70B in the plan view) W are set within a range of H:W=2:1 to 1:2 ($\frac{1}{2} \leq H/W \leq 2$). Here, the height direction and the width direction (a conveyance direction and a horizontal direction in plan view) are orthogonal to each other. According to such a setting, it is possible to inhibit an increase in size of the image forming apparatus 101 in either a vertical direction or a width direction, and to achieve overall downsizing of the image forming apparatus 101.

<Downstream-Side Conveyance Path>

The downstream-side conveyance path 73 is a path to convey the paper P in a substantially horizontal direction at a position higher than the upstream-side conveyance path 71, and includes the pair of upper and lower guide parts 73*a* and 73*b* facing each other. The guide parts 73*a* and 73*b* are resin or metal plate-shaped members (guide plates) arranged with a guide gap. In an upstream-side end part of the downstream-side conveyance path 73 in the conveyance direction, there is provided the intermediate conveyance roller 25 that conveys the paper P located in the guide gap between the guide parts 73*a* and 73*b*, to the downstream side.

<First Bent Part>

The first bent part 70A is a connection portion between a downstream end part of the upstream-side conveyance path 71 and an upstream end part of the intermediate conveyance path 72, and exhibits a bent shape that is convex downward in side view.

<Second Bent Part>

The second bent part 70B is a connection portion between a downstream end part of the intermediate conveyance path 72 and the downstream-side conveyance path 73, and exhibits a bent shape that is convex upward in side view.

<Duplexing Reversing Path>

The duplexing reversing path 81 is a path that reverses the paper P formed with an image on one side, after passing through each of the conveyance paths 71, 72, and 73, and returns the paper P to the intermediate conveyance path 72. The duplexing reversing path 81 includes a pair of guide parts 81*a* and 81*b* facing each other. The duplexing reversing path 81 is connected from below to an intermediate portion of an intermediate conveyance path 72 in the conveyance direction. In the duplexing reversing path 81, there is provided an intermediate conveyance roller 32 that conveys the paper P located in a guide gap between the guide parts 81*a* and 81*b*, to the downstream side.

<Manual Feed Conveyance Path>

The manual feed conveyance path 90 is a path to convey the paper P installed in a manual feed tray 21B.

The manual feed conveyance path 90 is connected to the intermediate conveyance path 72 or the second bent part 70B (in the present embodiment, the second bent part 70B) from above. The manual feed conveyance path 90 includes a manual feed upstream-side conveyance path 91 and a manual feed intermediate conveyance path 92, sequentially from the upstream side.

The manual feed upstream-side conveyance path 91 is a path to convey the paper P in a substantially horizontal direction above the upstream-side conveyance path 71, and includes a pair of upper and lower guide parts 91*a* and 91*b* facing each other. At an upstream-side end part of the manual feed upstream-side conveyance path 91, there is provided a second paper feeding part 22B that conveys the paper P installed in the manual feed tray 21B to the manual feed upstream-side conveyance path 91. In an intermediate portion of the manual feed upstream-side conveyance path 91 in the conveyance direction, there is provided an intermediate conveyance roller 23B that conveys the paper P located in a guide gap between the guide parts 91*a* and 91*b*, to the downstream side.

The manual feed intermediate conveyance path 92 is a path to convey the paper P in a diagonally downward direction above the intermediate conveyance path 72, and includes a pair of upper and lower guide parts 92*a* and 92*b* facing each other. A merging part between the manual feed intermediate conveyance path 92 and the second bent part 70B exhibits a bent shape that is convex downward. In an upstream-side end part of the manual feed intermediate conveyance path 92 in the conveyance direction, there is provided an intermediate conveyance roller 24B that conveys the paper P located in a guide gap between the guide parts 92*a* and 92*b*, to the downstream side.

<Friction Reducing Part>

To such the conveyance paths 71 to 73 and 92, a plurality of friction reducing parts 70*a* to 70*f*, 90*a*, and 90*b* are provided. Frictional resistance generated between the paper P and the friction reducing parts 70*a* to 70*f*, 90*a*, and 90*b* is smaller than frictional resistance generated between the paper P and the guide parts provided with the friction reducing parts 70*a* to 70*f*, 90*a*, and 90*b*. The friction reducing parts 70*a* to 70*f*, 90*a*, and 90*b* are provided on the respective guide parts, and are rotary members (rollers, bearings, and the like) that are rotatable around an axis that is parallel to a guide surface of the guide part and orthogonal to the conveyance direction of the paper P. The friction reducing parts 70*a* to 70*f*, 90*a*, and 90*b* rotate by abutting with the paper P located in the conveyance path, to passively convey the paper P.

<<Friction Reducing Part of First Bent Part>>

The first bent part 70A is provided with the friction reducing parts 70*a* and 70*b*. The friction reducing part 70*a* is provided on an inner side of the bend of the first bent part 70A, that is, on the upper guide part 71*a*. The friction reducing part 70*b* is provided on an outer side of the bend of the first bent part 70A, that is, on the lower guide part 71*b*.

<<Friction Reducing Part of Intermediate Conveyance Path>>

In the intermediate conveyance path 72, the friction reducing parts 70*c*, 70*d*, and 70*e* are provided sequentially from the upstream side. The friction reducing part 70*c* is provided on the lower guide part 72*b*, on a downstream side from the intermediate conveyance roller 24A and on an upstream side of a merging part between the intermediate conveyance path 72 and the duplexing reversing path 81. The friction reducing part 70*d* is provided on the upper guide part 72*a*, on a downstream side from the intermediate conveyance roller 24A and on an upstream side of the merging part between the intermediate conveyance path 72 and the duplexing reversing path 81. The friction reducing part 70*e* is provided on the lower guide part 72*b*, on a downstream side from the merging part between the intermediate conveyance path 72 and the duplexing reversing path 81.

<<Friction Reducing Part of Second Bent Part>>

The second bent part 70B is provided with the friction reducing part 70*f*. The friction reducing part 70*f* is provided on an inner side of the bend of the second bent part 70B, that is, on the upper guide part 73*a*.

<<Friction Reducing Part of Manual Feed Conveyance Path>>

The manual feed conveyance path 90 (more specifically, the manual feed intermediate conveyance path 92) is provided with the friction reducing parts 90*a* and 90*b*, sequentially from the upstream side. The friction reducing part 90*a* is provided near an upstream end part on the upper guide part 92*a*. The friction reducing part 90*b* is provided in an intermediate portion in the conveyance direction, on the lower guide part 92*b*.

<Paper Conveyance Method>

Next, a conveyance method of the paper P will be described in the order of conveyance from the paper feeding device 102, conveyance via the duplexing reversing path 81, conveyance from the manual feed tray 21B, and conveyance from the paper feeding tray 21A.

<<Conveyance Method of Paper Installed in Paper Feeding Device>>

The paper P installed in the paper feeding device 102 is conveyed in the upstream-side conveyance path 71 by the intermediate conveyance roller 23A, drawn from the upstream-side conveyance path 71 by the intermediate conveyance roller 24A to be conveyed in the intermediate conveyance path 72, and drawn from the intermediate conveyance path 72 by the intermediate conveyance roller 25 to be conveyed in the downstream-side conveyance path 73. Here, the friction reducing parts 70*a* and 70*b* suitably support the paper P to move from the upstream-side conveyance path 71 to the intermediate conveyance path 72. Next, the friction reducing part 70*c* abuts with a tip end part of the paper P having moved to the intermediate conveyance path 72, and suitably supports the paper to move in the intermediate conveyance path 72. Next, the friction reducing parts 70*d* and 70*e* suitably support the paper P to move in the intermediate conveyance path 72. Next, the friction reducing part 70*c* abuts with a rear end part of the paper P and suitably supports the paper P to move from the intermediate conveyance path 72 to the downstream-side conveyance path 73. Further, the friction reducing part 70*f* suitably supports the paper P to move from the intermediate conveyance path 72 to the downstream-side conveyance path 73.

<<Paper Conveyance Method Via Duplexing Reversing Path>>

Whereas, the paper P formed with an image on one side by the image forming parts 10Y to 10K is conveyed in the duplexing reversing path 81 by the intermediate conveyance roller 32, and conveyed in the downstream-side conveyance path 73 by the intermediate conveyance roller 25. Here, the friction reducing part 70*e* suitably supports the paper P to move in the intermediate conveyance path 72. Further, the friction reducing part 70*f* suitably supports the paper P to move from the intermediate conveyance path 72 to the downstream-side conveyance path 73.

<<Paper Conveyance Method Installed in Manual Feed Tray>>

Whereas, the paper P installed in the manual feed tray 21B is conveyed in the manual feed upstream-side conveyance path 91 by the intermediate conveyance roller 23B, conveyed in the manual feed intermediate conveyance path 92 by the intermediate conveyance roller 24B, and conveyed in the downstream-side conveyance path 73 by the intermediate conveyance roller 25. Here, the friction reducing part 90*a* abuts with a tip end part of the paper P having moved to the manual feed intermediate conveyance path 92, and suitably supports the paper P to move in the manual feed intermediate conveyance path 92. Next, the friction reducing part 90*b* suitably supports the paper P to move in the manual feed intermediate conveyance path 92. Next, the friction reducing part 90*b* abuts with a rear end part of the paper P and suitably supports the paper P to move from the manual feed intermediate conveyance path 92 to the downstream-side conveyance path 93. Further, the friction reducing part 70*f* suitably supports the paper P to move from the manual feed intermediate conveyance path 92 to the downstream-side conveyance path 73.

<<Conveyance Method of Paper Installed in Paper Feeding Tray>>

The paper P installed in the paper feeding tray 21A is conveyed to the intermediate conveyance path 72 via a conveyance path 41 connected to the first bent part 70A from below.

The image forming apparatus 101 according to the first embodiment of the present invention includes, as a conveyance to convey an object (the paper P) formed with an image, the upstream-side conveyance path 71, the intermediate conveyance path 72 connected to a downstream end part of the upstream-side conveyance path 71 via the first bent part 70A, and the downstream-side conveyance path 73 connected to the intermediate conveyance path 72 via the second bent part 70B. The second bent part 70B is bent to a side opposite to the first bent part 70A, and the friction reducing part 70*a* capable of abutting with the object conveyed in the first bent part 70A is provided on an inner side of the bend of the first bent part 70A. The intermediate conveyance path 72 includes: a pair of the guide parts 72*a* and 72*b* facing each other and forming the intermediate conveyance path 72; and the friction reducing parts 70*c*, 70*d* and 70*e* that are provided on both of a pair of the guide parts 72*a* and 72*b* and are capable of abutting with the object conveyed between a pair of the guide parts 72*a* and 72*b*.

Therefore, the image forming apparatus 101 can achieve both downsizing of the apparatus and high-speed conveyance of the object, by reducing the friction generated between the intermediate conveyance path 72 and the object.

In the image forming apparatus 101, the friction reducing part is a roller or a bearing.

Therefore, the image forming apparatus 101 can realize the friction reducing parts 70*c*, 70*d*, and 70*e* that reduce the friction generated between the intermediate conveyance path 72 and the object, with a simple configuration.

In the image forming apparatus 101, the downstream-side conveyance path 73 includes a pair of the guide parts 73*a* and 73*b* facing each other and forming the downstream-side conveyance path 73. Further, the guide gap between a pair of the guide parts 72*a* and 72*b* in the intermediate conveyance path 72 is set larger than the guide gap between a pair of the guide parts 73*a* and 73*b* in the downstream-side conveyance path 73.

Therefore, the image forming apparatus 101 can reduce the friction generated between the intermediate conveyance path 72 and the object in a state where the object is bent when being conveyed from the intermediate conveyance path 72 to the downstream-side conveyance path 73.

In the image forming apparatus 101, the downstream-side conveyance path 73 includes a pair of the guide parts 73*a* and 73*b* facing each other and forming the downstream-side conveyance path 73. Further, frictional resistance of a pair of the guide parts 72*a* and 72*b* in the intermediate conveyance path 72 is set to be smaller than frictional resistance of a pair of the guide parts 73*a* and 73*b* in the downstream-side conveyance path 73.

Therefore, the image forming apparatus 101 can reduce the friction generated between the intermediate conveyance path 72 and the object in a state where the object is bent when being conveyed from the intermediate conveyance path 72 to the downstream-side conveyance path 73.

The image forming apparatus 101 includes the friction reducing parts 70*b* and 70*f* that are provided on an outer side of the bend of the first bent part 70A and the second bent part 70B and are capable of abutting with the object conveyed in the first bent part 70A and the second bent part 70B.

Therefore, the image forming apparatus 101 can reduce the friction generated between the bent parts 70A and 70B and the object when the object passes through the bent parts 70A and 70B.

In the image forming apparatus 101, the distance H in the height direction of the second bent part 70B and the first bent part 70A and the distance W in the conveyance direction in plan view are set within the range of 2:1 to 1:2.

Therefore, the image forming apparatus 101 can suppress an increase in size in either a vertical direction or the horizontal direction, and can achieve the overall downsizing.

In the image forming apparatus 101, the intermediate conveyance path 72 has a merging part from the duplexing reversing path 81 in which the object formed with an image on one side is conveyed.

Therefore, the image forming apparatus 101 can suitably convey the object formed with an image on one side.

In the image forming apparatus 101, the friction reducing parts 70*c*, 70*d*, and 70*e* provided in the intermediate conveyance path 72 are rollers or bearings provided so as to avoid the merging part.

Therefore, the image forming apparatus 101 can inhibit that the object from the duplexing reversing path 81 is caught by the friction reducing parts 70*c*, 70*d*, and 70*e*.

In the image forming apparatus 101, the intermediate conveyance path 72 or the second bent part 70B has a merging part from the manual feed conveyance path 90 in which the object provided on the manual feed tray 21B is conveyed.

Therefore, the image forming apparatus 101 can suitably convey the object from the manual feed tray 21B.

In the image forming apparatus 101, a merging part between the manual feed conveyance path 90 and the intermediate conveyance path 72 or the second bent part 70B is bent. The merging part between the manual feed conveyance path 90 and the intermediate conveyance path 72 or the second bent part 70B includes the friction reducing part 70*f* that is provided on an inner side of the bend of the merging part and is capable of abutting with the object conveyed in the merging part.

Therefore, the image forming apparatus 101 can reduce the friction generated between the bent part and the object when the object merges with the conveyance path from the manual feed conveyance path 90.

In the image forming apparatus 101, the manual feed conveyance path 90 includes: a pair of the guide parts 92*a* and 92*b* facing each other and forming the manual feed conveyance path; and the friction reducing parts 90*a* and 90*b* that are provided on both of a pair of the guide parts 92*a* and 92*b* and are capable of abutting with the object conveyed between a pair of the guide parts 92*a* and 92*b*.

Therefore, the image forming apparatus 101 can reduce the friction generated between the manual feed conveyance path 90 and the object.

Second Embodiment

Figure 3:
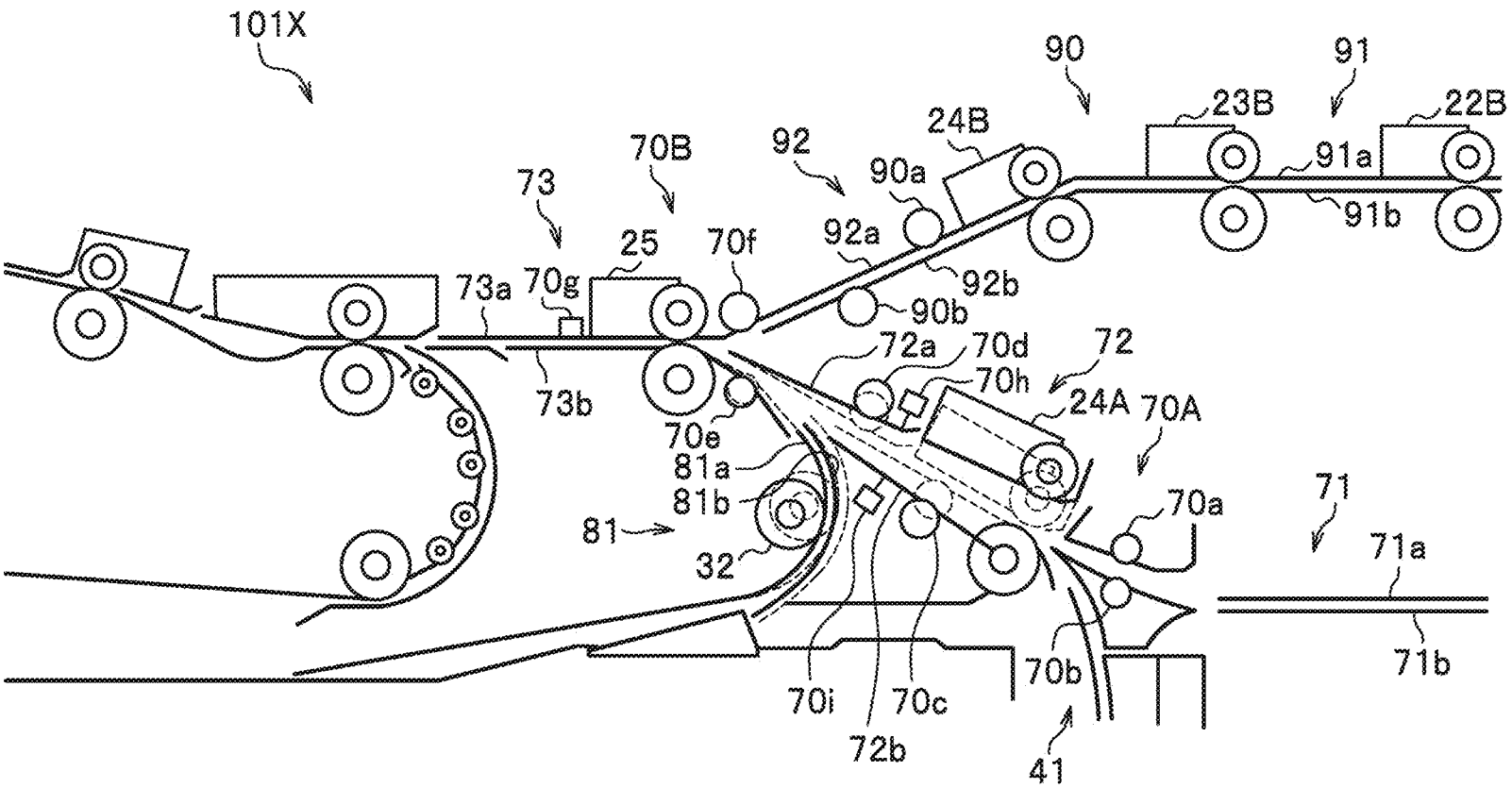
FIG. 3 is a view schematically showing a conveyance path of an image forming apparatus according to a second embodiment of the present invention.

Next, an image forming apparatus according to a second embodiment of the present invention will be described focusing on differences from the image forming apparatus 101 according to the first embodiment. As shown in FIG. 3, in an image forming apparatus 101X according to the second embodiment of the present invention, guide parts 72*a* and 72*b* can open and close at least one upstream end part of the guide parts 72*a* and 72*b*, with, as a supporting point, a downstream end part (second bent part 70B) of the guide parts 72*a* and 72*b*. Further, the image forming apparatus 101X includes a sensor 70*g* that detects paper P located on an intermediate conveyance roller 25, and movable mechanisms 70*h* and 70*i* that move the guide parts 72*a* and 72*b*. When the sensor 70*g* detects that the paper P has reached the intermediate conveyance roller 25, a control part 11 opens at least one of the guide parts 72*a* and 72*b* (at least the guide part 72*a* on an outer side of the bend) by controlling the movable mechanisms 70*h* and 70*i* to increase a radius of curvature of the second bent part 70B, and suitably supports conveyance of the paper P by the intermediate conveyance roller 25.

Note that, when the paper P is conveyed from a duplexing reversing path 81 to an intermediate conveyance path 72, the control part 11 controls the movable mechanisms 70*h* and 70*i* to close the guide parts 72*a* and 72*b*.

In the image forming apparatus 101X according to the second embodiment of the present invention, at least one of a pair of the guide parts 72*a* and 72*b* can be moved so as to increase a guide gap on an upstream side.

Therefore, for example, by increasing a guide gap on a downstream side when a tip end part of an object reaches the second bent part 70B, the image forming apparatus 101X can suitably convey the object from the intermediate conveyance path 72 to the downstream-side conveyance path 73.

Third Embodiment

Figure 4:
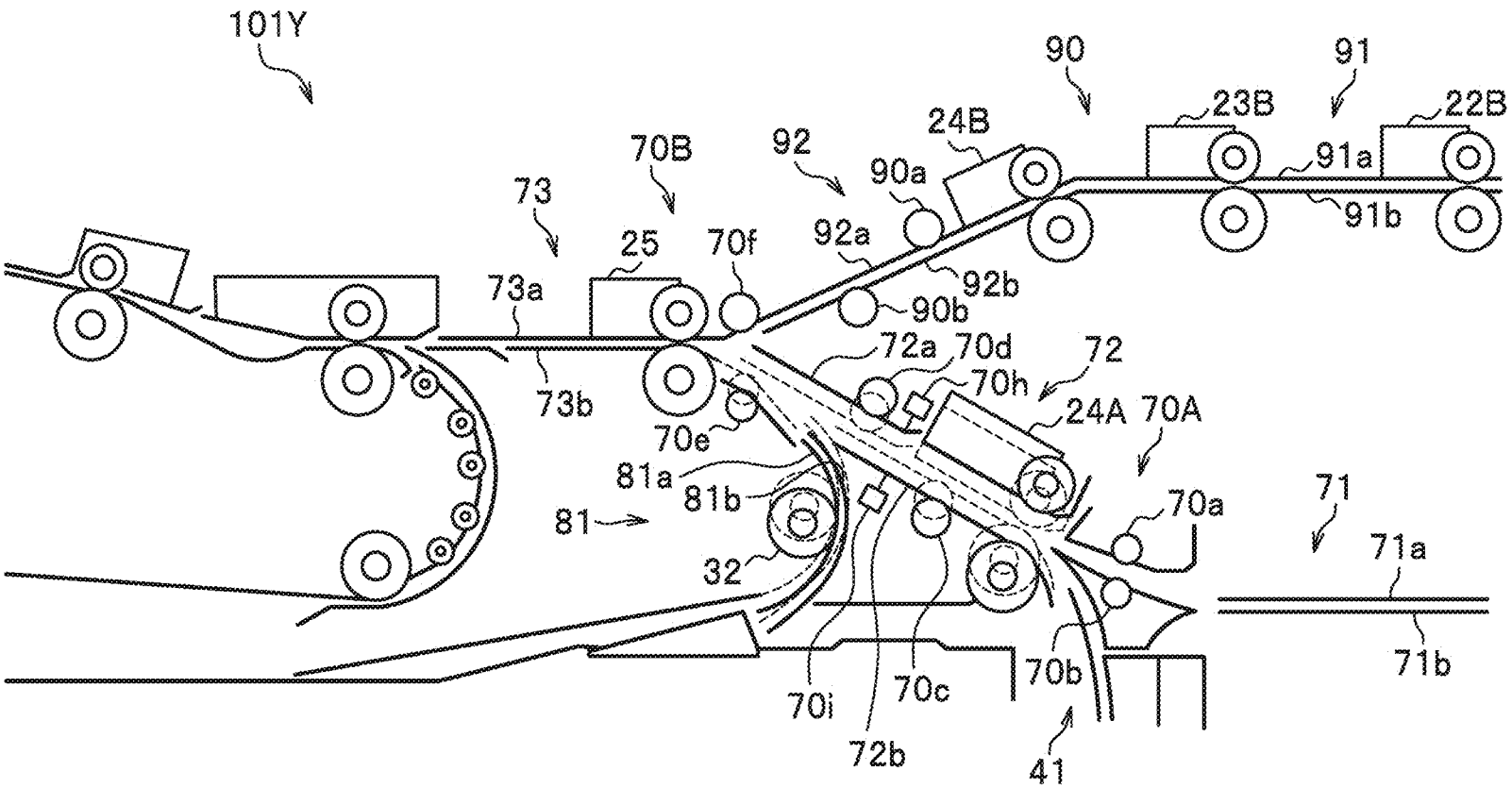
FIG. 4 is a view schematically showing a conveyance path of an image forming apparatus according to a third embodiment of the present invention.

Next, an image forming apparatus according to a third embodiment of the present invention will be described focusing on differences from the image forming apparatus 101 according to the first embodiment. As shown in FIG. 4, in an image forming apparatus 101Y according to the third embodiment of the present invention, guide parts 72*a* and 72*b* have a variable guide gap. Further, the image forming apparatus 101Y includes movable mechanisms 70*h* and 70*i* that move the guide parts 72*a* and 72*b*. By controlling the movable mechanisms 70*h* and 70*i* in accordance with a paper type setting to move at least one of the guide parts 72*a* and 72*b* (at least the guide part 72*a* on an outer side of the bend), a control part 11 changes a guide gap of an intermediate conveyance path 72 to reduce frictional resistance with paper P in the intermediate conveyance path 72. For example, the control part 11 can greatly change the guide gap of the intermediate conveyance path 72 as the paper P to be conveyed is harder or thicker.

Although embodiments of the present invention have been described and illustrated in detail, the disclosed embodiments are made for purposes of illustration and example only and not limitation, and can be appropriately modified without departing from the gist of the present invention. The scope of the present invention should be interpreted by terms of the appended claims. For example, the downstream-side conveyance path 73 may be provided at a position lower than the upstream-side conveyance path 71. In this case, the first bent part 70A is convex upward while the second bent part 70B is convex downward, and the upstream-side conveyance path 71, the intermediate conveyance path 72, and the downstream-side conveyance path 73 exhibits an S-shape opposite to that of the above-described embodiment.

What is claimed is:

1. An image forming apparatus comprising:

a conveyance device to convey an object formed with an image, the conveyance device including:

an upstream-side conveyance path;

an intermediate conveyance path connected to a downstream end part of the upstream-side conveyance path via a first bent part; and a downstream-side conveyance path connected to the intermediate conveyance path via a second bent part, wherein the second bent part is bent to a side opposite to the first bent part, on an inner side of a bend of the first bent part, a friction reducing part capable of abutting with the object conveyed in the first bent part is provided, and the intermediate conveyance path includes:

a pair of guide parts facing each other and forming the intermediate conveyance path; and a friction reducing part that is provided on both guide parts of the pair of the guide parts and is capable of abutting with the object conveyed between a pair of the guide parts; and wherein the downstream-side conveyance path includes a pair of guide parts facing each other and forming the downstream-side conveyance path, and frictional resistance of a pair of the guide parts in the intermediate conveyance path is set to be smaller than frictional resistance of a pair of the guide parts in the downstream-side conveyance path.

2. The image forming apparatus according to claim 1, wherein the friction reducing part of one or more of the first bent part or the guide parts is a roller or a bearing.

3. The image forming apparatus according to claim 1, wherein at least one of a pair of the guide parts is movable to increase a guide gap on an upstream side.

4. The image forming apparatus according to claim 1, wherein the downstream-side conveyance path includes a pair of guide parts facing each other and forming the downstream-side conveyance path, and a guide gap between a pair of the guide parts in the intermediate conveyance path is set to be larger than a guide gap between a pair of the guide parts in the downstream-side conveyance path.

5. The image forming apparatus according to claim 1, further comprising:

a friction reducing part that is provided on an outer side of a bend of the first bent part and the second bent part, and is capable of abutting with the object conveyed in the first bent part and the second bent part.

6. The image forming apparatus according to claim 1, wherein a distance in a height direction and a distance in a conveyance direction in plan view between the second bent part and the first bent part are set in a range of 2:1 to 1:2.

7. The image forming apparatus according to claim 1, wherein the intermediate conveyance path has a merging part from a duplexing reversing path in which the object formed with an image on one side is conveyed.

8. The image forming apparatus according to claim 7, wherein the friction reducing part provided in the intermediate conveyance path is a roller or a bearing provided to avoid interference with the merging part.

9. The image forming apparatus according to claim 1, wherein the intermediate conveyance path or the second bent part has a merging part from a manual feed conveyance path in which the object provided on a manual feed tray is conveyed.

10. The image forming apparatus according to claim 9, wherein the merging part between the manual feed conveyance path and the intermediate conveyance path or the second bent part is bent, and the merging part between the manual feed conveyance path and the intermediate the merging part between the manual feed conveyance path and the intermediate conveyance path or the second bent part includes a friction reducing part that is provided on an inner side of a bend of the merging part and is capable of abutting with the object conveyed in the merging part.

11. The image forming apparatus according to claim 9, wherein the manual feed conveyance path includes: a pair of guide parts facing each other and forming the manual feed conveyance path; and a friction reducing part that is provided on both guide parts of the pair of the guide parts and is capable of abutting with the object conveyed between the pair of the guide parts.

12. An image forming apparatus, comprising:

a conveyance device to convey an object formed with an image, the conveyance device including:

an upstream-side conveyance path;

an intermediate conveyance path connected to a downstream end part of the upstream-side conveyance path via a first bent part; and a downstream-side conveyance path connected to the intermediate conveyance path via a second bent part, wherein the second bent part is bent to a side opposite to the first bent part, on an inner side of a bend of the first bent part, a friction reducing part capable of abutting with the object conveyed in the first bent part is provided, and the intermediate conveyance path includes:

a pair of guide parts facing each other and forming the intermediate conveyance path; and a friction reducing part that is provided on both guide parts of the pair of the guide parts and is capable of abutting with the object conveyed between a pair of the guide parts, wherein a distance in a height direction and a distance in a conveyance direction between the second bent part and the first bent part are set in a range of 2:1 to 1:2.

13. An image forming apparatus, comprising:

a conveyance device to convey an object formed with an image, the conveyance device including:

an upstream-side conveyance path;

an intermediate conveyance path connected to a downstream end part of the upstream-side conveyance path via a first bent part; and a downstream-side conveyance path connected to the intermediate conveyance path via a second bent part, wherein the second bent part is bent to a side opposite to the first bent part, on an inner side of a bend of the first bent part, a friction reducing part capable of abutting with the object conveyed in the first bent part is provided, and the intermediate conveyance path includes:

a pair of guide parts facing each other and forming the intermediate conveyance path; and a friction reducing part that is provided on both guide parts of the pair of the guide parts and is capable of abutting with the object conveyed between a pair of the guide parts, wherein the intermediate conveyance path has a merging part from a duplexing reversing path in which the object formed with an image on one side is conveyed.

* * * * *